US006155179A

United States Patent [19]

Aust et al.

[11] Patent Number: 6,155,179

[45] Date of Patent: Dec. 5, 2000

[54] WORK STATION FOR AN X-RAY EXAMINING APPARATUS

[75] Inventors: Stefan Aust, Niedernhausen; Helmut Thoma, Mainz, both of Germany

[73] Assignee: Heimann Systems GmbH, Wiesbaden, Germany

[21] Appl. No.: 09/332,532

[22] Filed: Jun. 14, 1999

Related U.S. Application Data

[63] Continuation of application No. 09/268,691, Mar. 16, 1999.

[30] Foreign Application Priority Data

Mar. 10, 1999 [DE] Germany ..... 199 10 615

[51] Int. Cl.[7] ..... A47B 37/00

[52] U.S. Cl. ..... 108/50.01

[58] Field of Search ..... 108/50.01, 50.02, 108/50.11; 297/217.3, 172; 312/223.3, 235.2, 235.5, 235.9

[56] References Cited

U.S. PATENT DOCUMENTS

| | | | |
|---|---|---|---|
| 2,102,261 | 12/1937 | Forte | 297/172 X |
| 2,140,635 | 12/1938 | Konarski | 297/172 |
| 4,880,270 | 11/1989 | Cooper | 297/217.3 X |
| 5,054,852 | 10/1991 | Tholkes | 297/172 |
| 5,056,864 | 10/1991 | Cooper | 297/217.3 X |
| 5,174,223 | 12/1992 | Nagy et al. | 108/50.01 |
| 5,522,323 | 6/1996 | Richard | 108/50.01 X |
| 5,765,910 | 6/1998 | Larkin et al. | 297/172 |

FOREIGN PATENT DOCUMENTS

| | | |
|---|---|---|
| 25 32 218 | 9/1982 | Germany . |
| 295 10 803 U | 11/1995 | Germany . |

OTHER PUBLICATIONS

Finkenzeller et al, "Das neue Untersuchungsgerät Orbiskop und seine technischen Besonderheiten", Rö.Bl May 23, 1970, pp. 221–226.

*Primary Examiner*—José V. Chen
*Attorney, Agent, or Firm*—Venable; Gabor J. Kelemen

[57] ABSTRACT

A work station for an X-ray examining apparatus includes a seat-and-standing unit; a monitor disposed in a range of vision of an operator positioned in the seat-and-standing unit; a keyboard; a first device for securing the keyboard to the monitor for pivotal motion of the keyboard relative to the monitor; a second device for adjusting a height position of the seat-and-standing unit; a third device for adjusting a height position of the monitor; and a fourth device for providing for a turning motion of the monitor about a vertical axis, whereby the first, second, third and fourth devices provide the work station with ergonomic properties.

9 Claims, 3 Drawing Sheets

FIG.1
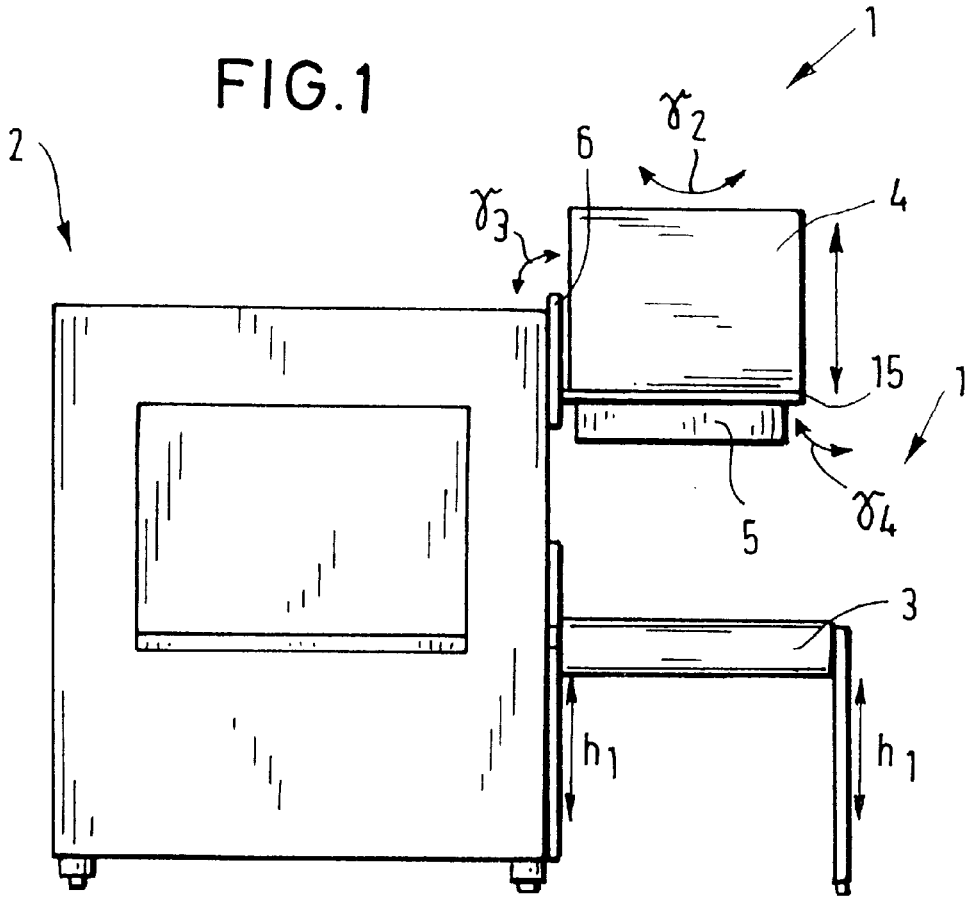
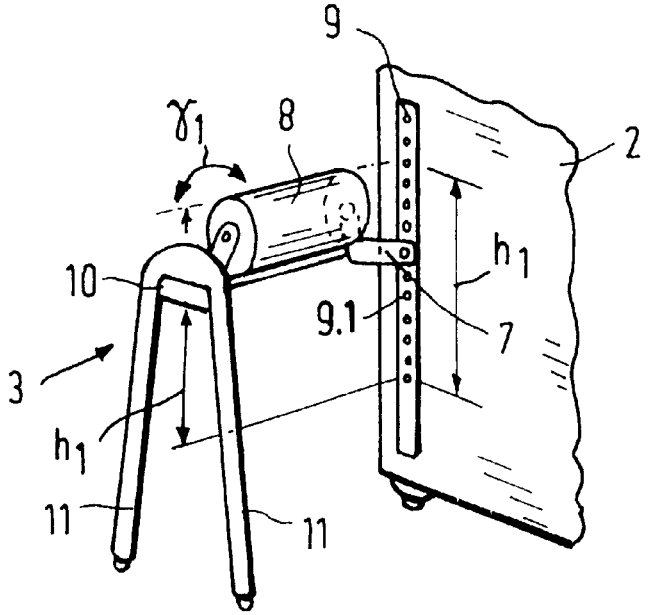
FIG.2

WORK STATION FOR AN X-RAY EXAMINING APPARATUS

CROSS REFERENCE TO RELATED APPLICATION

This is a continuation of U.S. patent application Ser. No. 09/268,691 filed Mar. 16, 1999.

This application claims the priority of German Application No. 199 10 615.0 filed Mar. 10, 1999, which is incorporated herein by reference.

BACKGROUND OF THE INVENTION

This invention relates to a work station which is associated with an X-ray examining apparatus and which includes a seating unit, a display device (monitor) as well as a keyboard.

Conventional work stations for X-ray examining apparatus have commercially available seats and tables which do not allow an individual adaptation to the body dimensions and posture of the operating personnel. Such a lack of adaptation leads to a rapid tiring of the operator, in addition to body aches that may develop.

SUMMARY OF THE INVENTION

It is an object of the invention to provide an improved, ergonomical work station of the above-outlined type.

This object and others to become apparent as the specification progresses, are accomplished by the invention, according to which, briefly stated, the work station for an X-ray examining apparatus includes a seat-and-standing unit; a monitor disposed in a range of vision of an operator positioned in the seat-and-standing unit; a keyboard; a first device for securing the keyboard to the monitor for pivotal motion of the keyboard relative to the monitor; a second device for adjusting a height position of the seat-and-standing unit; a third device for adjusting a height position of the monitor; and a fourth device for providing for a turning motion of the monitor about a vertical axis, whereby the first, second, third and fourth devices provide the work station with ergonomic properties.

The invention is based on the principle to provide a body-supporting unit which is designed as an adjustable seat-and-standing unit and to arrange the seat-and-standing unit and a monitor height-adjustably at the X-ray apparatus and further, to support the monitor to be rotatable in its horizontal plane and to secure a keyboard to the monitor for pivotal motion about a horizontal axis. This arrangement permits the operating personnel to adjust the work station to the individual comfort requirements.

According to an advantageous embodiment of the invention, the seat-and-standing unit has a height-adjustably guided body-supporting component which is directly connected with the X-ray apparatus by a guide mechanism. The body-supporting component serves as a sitting and standing aid for the operator. According to another advantageous embodiment, the seat-and-standing unit is separate from the X-ray examining apparatus and the unit has two supporting and guiding portions into which the body-supporting component extends. The body-supporting component itself is positioned within the seat-and-standing unit in such a manner that it may be forwardly and rearwardly adjusted in addition to height adjustment. The monitor is secured to a height-adjusting unit which, in turn, is directly mounted on a pedestal at the X-ray apparatus. The monitor is mounted for rotation about its own, substantially vertical, axis or, as the case may be, about the longitudinal axis of the height-adjusting unit. This arrangement has the advantage that the operator, when leaving the seat-and-standing unit, may swing away the monitor and thus can fully stand up without being obstructed in any way. The keyboard has a palm support and is secured to the monitor preferably for a stepwise pivotal motion about a horizontal axis. The height-adjusting unit may be operated manually, or may be driven hydraulically or by a motor.

BRIEF DESCRIPTION OF THE DRAWINGS

FIG. 1 is a schematic front elevational view of a work station of an X-ray examining apparatus according to a preferred embodiment of the invention.

FIG. 2 is a fragmentary schematic perspective view of a seat-and-standing unit forming part of the work station according to a preferred embodiment of the invention.

DESCRIPTION OF THE PREFERRED EMBODIMENTS

Figure 3:
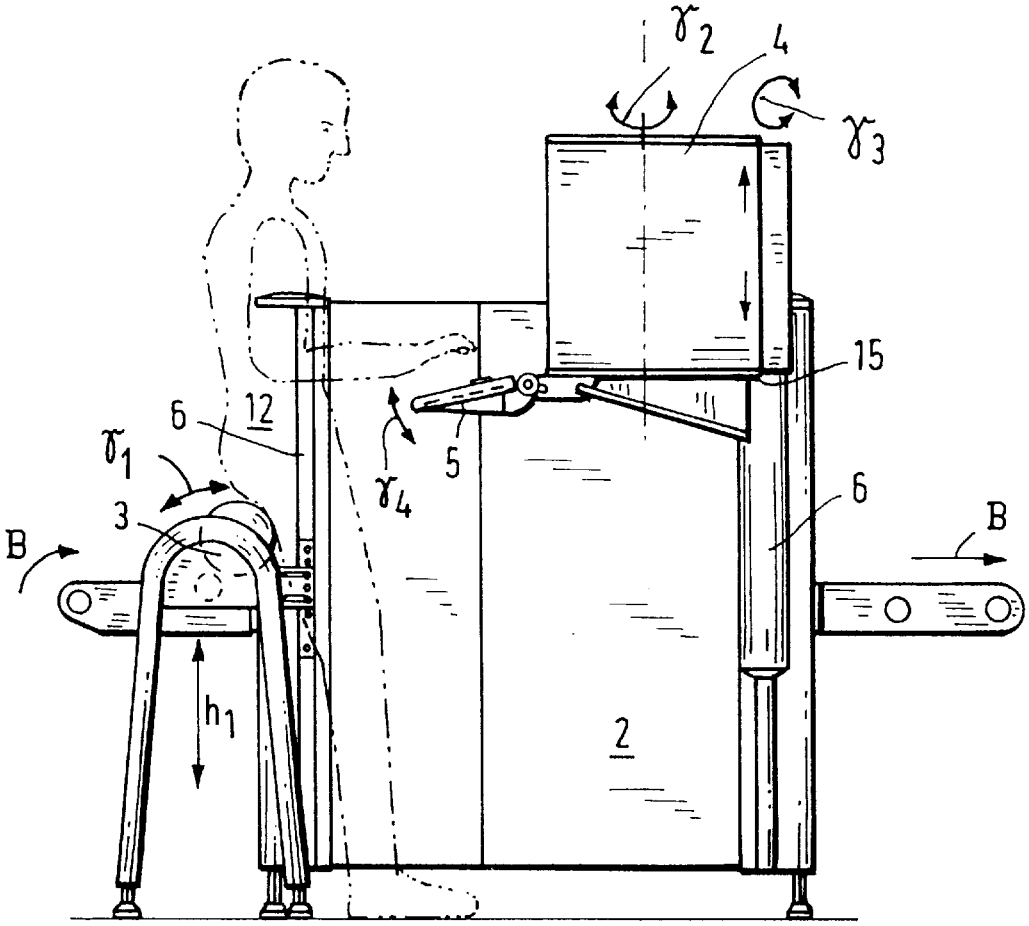
FIG. 3 is a schematic side elevational view of the construction shown in FIG. 1.

FIG. 1 shows an ergonomically constructed work station 1 of an X-ray examining apparatus 2. The work station 1 has a seat-and-standing unit 3, a monitor 4 and a keyboard 5. The seat-and-standing unit 3 and the monitor 4 are height-adjustably and preferably directly mounted on the X-ray examining apparatus 2. The monitor 4 is supported on a height-adjusting unit 6 for a vertical motion and for rotation about a vertical axis of the height-adjusting unit 6 which is mounted on a pedestal preferably attached to the X-ray examining apparatus 2. The keyboard 5 is mounted on the monitor 4 and may be pivotally moved about a horizontal axis.

FIG. 2 shows the seat-and-standing unit 3 in more detail. The seat-and-standing unit 3 has a supporting and guiding portion 11 in which a body-supporting component 8 is height-adjustably guided. The supporting and guiding portion 11 may be height adjustable by means of telescoping legs. On the side of the body-supporting component 8 a ratchet mechanism 10, such as a resiliently supported pin is provided which, upon a height adjustment h1 within the supporting and guiding part 11, snaps into a respective detent hole (not shown). A further detent mechanism 7 which is mounted on the other side of the body-supporting component 8, is guided and supported on a guide 9 mounted on the X-ray examining apparatus 2 in such a manner that the detent mechanism 7, upon a height adjustment h1 of the body-supporting component 8, snaps into the respective hole 9.1 of the guide 9. Advantageously, the two detent mechanisms 7 and 10 have similar constructions whereby both these mechanisms may be operated by a common device, such as a non-illustrated lever. It is, however, also feasible to operate the height adjustments h1 by a motor or by a hydraulic mechanism. In accordance with a further advantageous embodiment, the body-supporting component 8 too, may be adjusted within the seat-and-standing unit 3. Such an adjustment about an angle y1 provides that an operating person 12 (FIG. 3) may work closer to or at a greater distance from the monitor 4 at the X-ray examining apparatus 2, whereby different arm lengths of the operator 12 are being taken into account.

As seen in FIG. 3, the monitor 4 is height-adjustable and may be turned about vertical and horizontal axes. By means of the height-adjusting unit 6 which may be raised or lowered manually, by a motor or hydraulically, the monitor 4 is adapted to the line of sight of the operator 12. For an adaptation to further local characteristics and to the desired working position relative to the running direction B of a conveyor belt on which, for example, pieces of luggage to be examined by the X-ray apparatus 2 are advanced, the monitor 3, together with the keyboard 5, may be pivoted about an angle of y2 of approximately 180° about its own vertical axis. For this purpose the monitor is mounted, for example, on a rotatably supported disk 15 lying in a horizontal plane. In case the diameter of the disk 15 is greater than the monitor 4, the monitor 4 may be rotated through a full circle. It is a further possibility to pivot the monitor 4 about an angle y3 about the longitudinal axis of the height-adjusting device 6 so that the disk 15 is swung together with the monitor 4. In such an arrangement, if the monitor 4 and the X-ray examining apparatus 2 are at the same height, the monitor 4 may be pivoted about an angle y3 through up to 180°. In case the monitor 4 is moved upwardly by the height-adjusting unit 6 beyond the X-ray examining apparatus 2, the monitor 4 can be turned about a full circle.

Further, the keyboard 5 may be pivotally supported such that it may be swung 50° downwardly from its operational (servicing) plane which is arranged preferably at an angle of 105° to the monitor 4. In this manner, various servicing heights for the keyboard 5 may also be set. The keyboard 5 is stepwise arrestable in the various angular positions y4. The detent mechanism for such a stepwise adjustment of the keyboard 5 may be a pin-type detent arranged on either side of the keyboard 5 and provided preferably with two pins which are inserted in predetermined holes. On the other side of the keyboard 5 a non-illustrated spring-loaded ball detent is mounted whereby the detent positions of the pins are predetermined on the opposite keyboard side.

Figure 4:
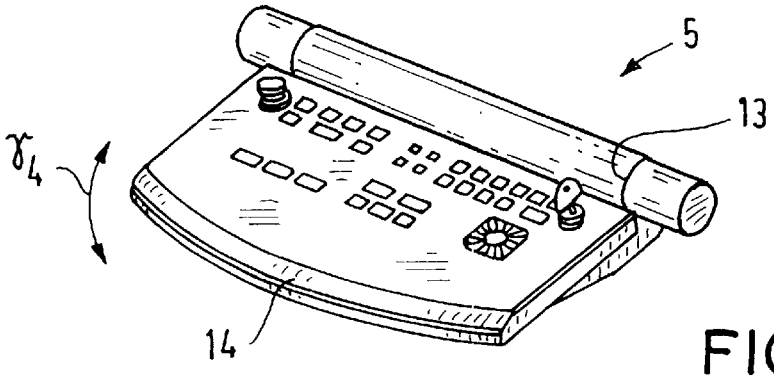
FIG. 4 is a perspective view of a keyboard forming part of the preferred embodiment.

As shown in FIG. 4, the keyboard 5 is provided with a palm support 14 for supporting the hands of the operator 12 when the keyboard is used.

By means of the ergonomic work station 1 at the X-ray examining apparatus 2 all individual body characteristics and comfort requirements of the operator 12 may be considered, while taking into account health and physical/psychological aspects.

Figure 6:
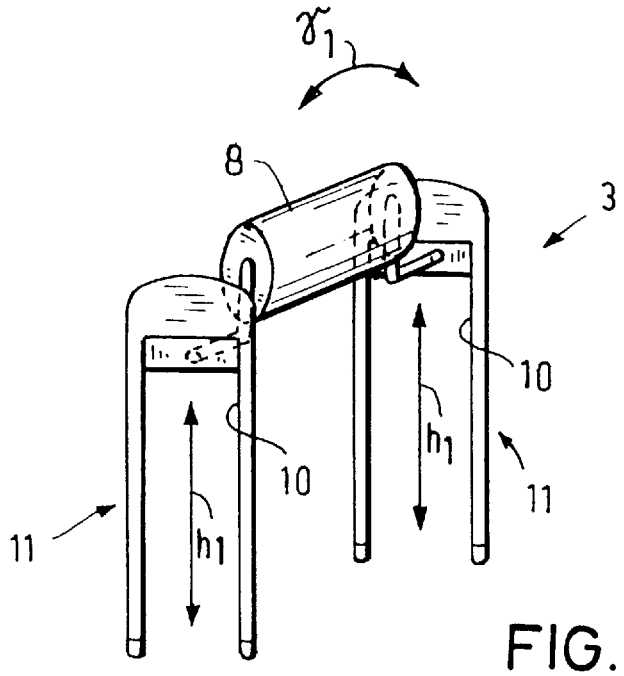
FIG. 6 is a fragmentary schematic perspective view of a separate seat-and standing unit.

It is to be understood that alterations within the scope of the invention are feasible. Thus, the seat-and-standing unit 3 as well as the monitor 4 with the keyboard 5 may be set up separately from the X-ray examining apparatus 2 (FIG. 6). For such a purpose the seat-and-standing unit is provided with a second supporting and guiding part 11 in which the body-supporting component 8 is guided and arrested.

Figure 5:
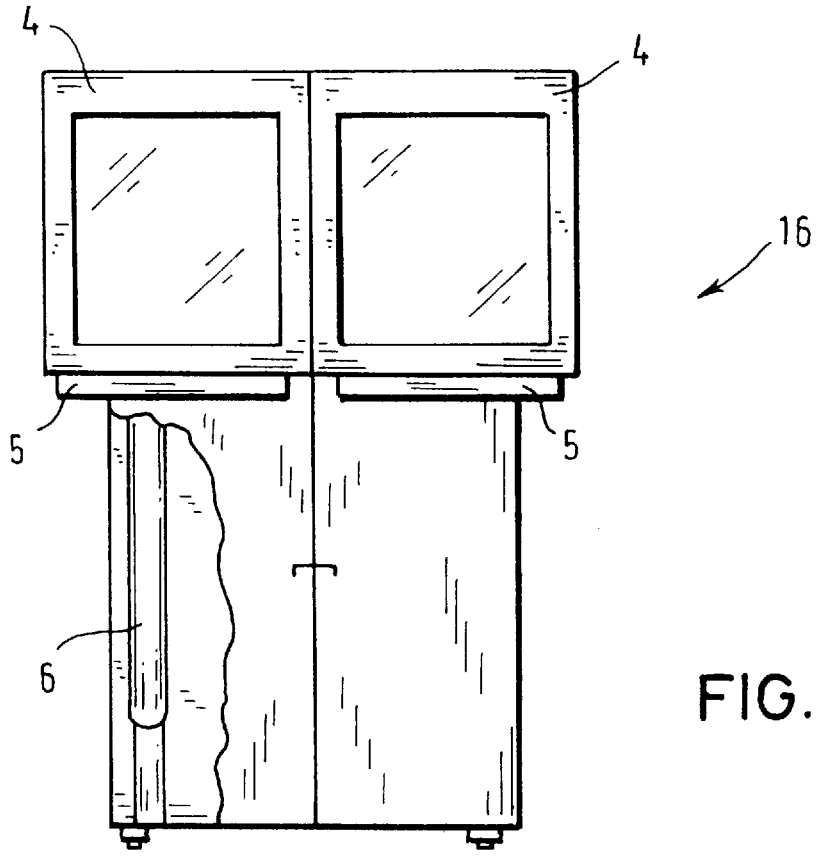
FIG. 5 is a schematic front elevational view of an embodiment of a separate operating counter of the work station according to another preferred embodiment of the invention.

FIG. 5 shows an embodiment in which the monitor 4 and the keyboard 5 are arranged separately from the X-ray examining apparatus 2. According to an advantageous variant, on the control counter 16 as a column, two monitors 4 may be mounted. The height-adjusting unit 6 may simultaneously adjust the height of both monitors 4 or separate height-adjusting units (not shown) may serve for the individual adjustment of the two monitors 4. The extent of pivotal motion of the individual monitors 4 is limited if the two monitors are to be turned separately and are arranged close to one another. Both monitors may be secured to a rotatably supported single disk (not shown) for a pivotal or turning motion of the monitors 4 as a unit.

It will be understood that the above description of the present invention is susceptible to various modifications, changes and adaptations, and the same are intended to be comprehended within the meaning and range of equivalents of the appended claims.

What is claimed is:

1. A work station in combination with an X-ray examining apparatus for inspecting objects, comprising (a) a seat-and-standing unit;

(b) a monitor mounted on said X-ray examining apparatus and disposed in a range of vision of an operator positioned in said seat-and-standing unit;

(c) a keyboard;

(d) first means for securing said keyboard to said monitor for pivotal motion of said keyboard relative to said monitor;

(e) second means for adjusting a height position of said seat-and-standing unit;

(f) third means for adjusting a height position of said monitor with respect to said X-ray examining apparatus; and (g) fourth means for providing for a turning motion of said monitor about a vertical axis; whereby said first, second, third and fourth means provide said work station with ergonomic properties.

2. The combination as defined in claim 1, wherein said seat-and-standing unit includes a body-supporting component having opposite first and second sides; further wherein said second means includes (a) a supporting and guiding portion connected to said body-supporting component at said first side thereof for vertically guiding said body-supporting component;

(b) a guide being attached to said X-ray examining apparatus and being disposed at said second side of said body-supporting component; and (c) first and second detents situated at respective said first and second sides of said body-supporting component for engaging into said supporting and guiding portion and into said guide, respectively, for arresting said body-supporting component in a selected height position.

3. The combination as defined in claim 2, further comprising fifth means for providing for an angular adjustability of said body-supporting component with respect to said supporting and guiding portion.

4. The combination as defined in claim 1, wherein said seat-and-standing unit includes a body-supporting component having opposite first and second sides; further wherein said second means includes (a) two supporting and guiding portions disposed on respective first and second sides of said body-supporting component for vertically guiding said body-supporting component; and (b) first and second detents situated at respective said first and second sides of said body-supporting component for engaging into said first and second supporting and guiding portion, respectively, for arresting said body-supporting component in a selected height position.

5. The combination as defined in claim 3, further comprising fifth means for providing for an angular adjustability of said body-supporting component with respect to said supporting and guiding portions.

6. The combination as defined in claim 1, wherein said monitor has a central axis, and further wherein said vertical axis coincides with said central axis.

7. The combination as defined in claim 1, wherein said third means has a longitudinal axis and further wherein said vertical axis coincides with said longitudinal axis.

8. The combination as defined in claim 1, further comprising a palm support connected to said keyboard.

9. The combination as defined in claim 1, further wherein said monitor and said keyboard are mounted on a column; said third means being integrated in said column.

* * * * *